US006338677B1

(12) United States Patent
White

(10) Patent No.: US 6,338,677 B1
(45) Date of Patent: Jan. 15, 2002

(54) VENT CONTROL SYSTEM

(76) Inventor: Samuel J White, 16184 Space Dr., Moreno Valley, CA (US) 92551-9246

( * ) Notice: Subject to any disclaimer, the term of this patent is extended or adjusted under 35 U.S.C. 154(b) by 0 days.

(21) Appl. No.: 09/660,501

(22) Filed: Sep. 12, 2000

(51) Int. Cl.[7] ..... F24F 13/14

(52) U.S. Cl. ..... 454/335; 454/256; 454/299; 454/318; 454/319

(58) Field of Search ..... 454/256, 292, 454/299, 313, 318, 319, 320, 335

(56) References Cited

U.S. PATENT DOCUMENTS

| | | | | |
|---|---|---|---|---|
| 4,150,788 A | | 4/1979 | Matsumoto et al. | |
| 4,945,822 A | | 8/1990 | Hicks et al. | |
| 4,997,030 A | | 3/1991 | Goto et al. | |
| 5,004,149 A | | 4/1991 | Narikiyo et al. | |
| 5,014,610 A | | 5/1991 | Twito | |
| 5,312,298 A | | 5/1994 | Myers | |
| 5,345,966 A | * | 9/1994 | Dudley | 454/335 |
| 5,441,451 A | | 8/1995 | Jeung | |
| 5,449,143 A | | 9/1995 | Hur | |
| 5,449,319 A | * | 9/1995 | Dushane et al. | 454/319 |
| 5,704,832 A | | 1/1998 | Borrell | |
| 5,984,775 A | | 11/1999 | Lee et al. | |
| 6,050,892 A | | 4/2000 | Sodec | |

* cited by examiner

*Primary Examiner*—Jiping Lu
(74) *Attorney, Agent, or Firm*—Michael I Kroll

(57) ABSTRACT

A system for controlling the opening and closing of vents within a structure. The system includes a plurality of vents positioned around the structure and a control panel is centrally positioned in a readily accessible position within the structure. The vents each include a cover plate having a recess extending therethrough a plurality of louvers positioned in spaced parallel relationship within the recess and a device for automatically pivoting the plurality of louvers between an open position and closed position. The control panel includes a plurality of control buttons, each control button controlling pivoting a respective one of the plurality of louvers between the open and closed positions. A lever connects the plurality of louvers within each vent together causing the louvers to move together. The pivoting device for each vent includes first and second solenoids and a latch and spring device connected between both the first and second solenoids and the lever. The first and second solenoids are each controlled by a respective one of the control buttons to rotate causing the latch and spring device to exert a force on the lever such that the lever pivots the plurality of louvers into one of the open or closed positions. Each of the vents further includes a manually operated lever for moving the louvers between the open and closed positions.

4 Claims, 7 Drawing Sheets

VENT CONTROL SYSTEM

BACKGROUND OF THE INVENTION

1. Field of the Invention

The present invention relates generally to vents and, more specifically, to heating and cooling vents able to be opened and closed from a central location thereby controlling the flow of heated and cooling air to a specific area of a structure and reducing the heating and cooling costs of the structure.

2. Description of the Prior Art

Numerous types of air vent control system devices designed for the control of air flow have been provided in the prior art. For example, U.S. Pat. Nos. 4,150,788; 4,945,822; 4,997,030; 5,004,149; 5,014,610; 5,312,298; 5,441,451; 5,449,143; 5,704,832; 5,984,775 and 6,050,892 all are illustrative of such prior art. While these units may be suitable for the particular purpose to which they address, they would not be as suitable for the purposes of the present invention as heretofore described.

U.S. Pat. No. 4,150,788

Inventor: Yoshihisa Matsumoto et al.

Issued: Apr. 24, 1979

A remote-controlled forced-circulation central air-conditioning system comprising a central heat-exchanger unit and a plurality of terminal air-conditioning units which are connected to the central heat-exchanger unit through terminal valves, respectively, which are arranged in parallel with one another, wherein a water circulation pump and the central heat-exchanger unit are started and shut off upon detection of variation in the pressure and/or the temperature of the liquid such as hot water in the liquid supply circuit leading to the terminal air-conditioning units when the terminal valve or valves are opened up and thereafter closed. The system may include a terminal heat-exchanger unit such as a bath.

U.S. Pat. No. 4,945,822

Inventor: Lester R. Hicks et al.

Issued: Aug. 7, 1990

An air control apparatus for a forced air central air conditioning system of the type having an air conditioning unit for conditioning air and a duct for conducting the conditioned air from the unit to a living area of a building. The air control apparatus includes a frame having a border and an air passage defined by the border, the border having a first surface for attachment to a first portion of the duct and an opposite second surface for attachment to a second portion of the duct, and an air seal slidably disposed in the frame between the first and second surfaces of the border, the air seal being movable in and out of the air passage to open and close the air passage and thereby regulate the flow of air therethrough. A handle is removably attached to the air seal and extends away from the frame for allowing the air passage to be manually opened and closed from within the living area of the building. A forced air central air conditioning system having an air control apparatus for regulating the flow of air through the system is also provided.

U.S. Pat. No. 4,997,030

Inventor: Yukifumi Goto et al.

Issued: Mar. 5, 1991

A central air conditioning system includes an air conditioning apparatus having a system controller and a variable air volume controller having a damper which controls the amount of conditioned air fed from the air conditioning apparatus into each room to be air-conditioned. Each room is provided with a room remote controller for controlling the operation of the air volume controller. The room remote controller outputs a start/stop command signal to control the operation of both the air conditioning apparatus and the air volume controller. The temperature of conditioned air fed from the air conditioning apparatus is maintained at a prescribed value determined on the basis of the desired room temperature in each room.

U.S. Pat. No. 5,004,149

Inventor: Hidetoshi Narikiyo et al.

Issued: Apr. 2, 1991

A central air conditioning system includes a compensating control function in which the prescribed target temperature Tfs of the conditioned air supplied from the air conditioning apparatus to a main duct is changed from the original value to a prescribed value of a modified target temperature Tfm to establish the target temperature Tfs when the actual room temperature Ta in each room does not achieve a corresponding desired room temperature Ts even though the damper of the corresponding air volume control unit is positioned at either the fully opened position or the closed position. The temperature of the conditioned air from the air conditioning apparatus is controlled in accordance with the target temperature Tfs, and the target temperature Tfs of the conditioned air is further changed to successive values of the modified target temperature Tfm until the actual room temperature Ta in each room achieves the corresponding desired room temperature Ts.

U.S. Pat. No. 5,014,610

Inventor: Isreal Twito

Issued: May 14, 1991

A modular outlet end units, or louvre units, for air ducts leading from a central air-conditioning plant, the louvre unit includes a plurality of sections which are include means for interconnection of a plurality of louvre units in order to enable the construction of any required size or dimension of outlet.

U.S. Pat. No. 5,312,298

Inventor: Leroy Myers

Issued: May 17, 1994

Floor vents for alternately supplying air to a conditioned space. Such vents, used in combination with a heating or cooling system, facilitate the delivery of air in a desired direction. The plastic vent may be constructed of pigmented material in a desired color. Louvers with integrally formed gears are pivotally mounted between ends of the vent, and are repostioned by a thumbwheel located below the upper surface of the grille portion of the vent, to thereby avoid damage to the gear by foot traffic above the vent. The louvers are provided with integrally formed bushings and rotatable end elements to enhance rotation and reliability.

U.S. Pat. No. 5,441,451

Inventor: Choon N. Jeung

Issued: Aug. 15, 1995

An air vent includes a louver blade mounted in a housing for rotation about an axis. A motor output shaft is connected to a driving link to rotate the driving link about the axis. A driven link in the form of a crank arm extends from the driving link to the louver blade. A spring in the form of a torsional coil spring interconnects the driving link and the driven link for transmitting rotation therebetween to adjust the louver blade. When an undesired external force is applied to the louver blade, the spring can yield elastically to prevent relative movement between the driving link and driven link in order to protect the motor.

U.S. Pat. No. 5,449,143

Inventor: Nam S. Hur

Issued: Sep. 12, 1995

An air vent includes a louver blade rotatable to adjusted positions by a motor. A control mechanism which connects the motor with the louver blade includes a control member connected to the motor, and a rotation transmitting member connecting the control member to the louver blade. The control member and rotation transmitting member are rotatable about a common axis. The rotation transmitting member and control member are capable of limited relative rotation in the event that an unwanted external force is applied to the louver blade, in order to isolate the motor from that external force. Spring-biased return blocks engage an elliptically shaped portion of the rotation transmitting member to return the louver blade to a prescribed angular relationship to the control member when the external force is relieved.

U.S. Pat. No. 5,704,832

Inventor: Gustavo Borrell

Issued: Jan. 6, 1998

An air conditioning vent cover assembly to be disposed over an outlet vent of an air conditioner duct, and including a frame structured for secure, fitted engagement over the outlet vent. The frame itself includes an exterior face having a plurality of openings formed therein so as to permit air flow therethrough from the vent and provide an attractive exterior appearance. Furthermore, rotatably connected to the frame is at least one propeller assembly having a central hub and at least one blade extending from a perimeter of the central hub. The propeller assembly is structured to freely rotate as a result of air flow from the air conditioning duct flowing thereover, such that the air flow is dispersed and more evenly distributed into the room as it passes from the propeller assembly through the exterior face of the frame. In addition to evenly dispersing the air flow, the propeller assembly is equipped to distribute an air freshener into the air flow such that it will circulate into the room and provide it with a pleasant aroma.

U.S. Pat. No. 5,984,775

Inventor: Kun-hyung Lee

Issued: Nov. 16, 1999

An apparatus for controlling air flow includes a grating having a plurality of air vents, a shutter assembly composed of a shutter fixed plate, having a plurality of first openings, attached to a lower surface of the grating, and a shutter moving plate, having a plurality of second openings corresponding to the first openings, movably disposed between the grating and the fixed plate. An opening-ratio controller moves the moving plate with respect to the fixed plate whereby an opening ratio defined by relative positions of the first openings and the second openings is controlled. The separation between the grating and the shutter fixed plate my be the thickness of the shutter moving plate. The opening-ratio controller may include an opening-ratio controlling screw having a pinion attached to the screw end.

U.S. Pat. No. 6,050,892

Inventor: Franc Sodec

Issued: Apr. 18, 2000

An air outlet vent (1) adapted in a floor (6) and connected to a heating, ventilating and air-conditioning air supply duct (30) includes a cylindrical housing (2) and a cover plate (4) that covers the top end of the housing (2). The plate (4) includes a first group of air outlet openings in the form of concentric circular arcuate slits (11) extending over a first sector of the plate (4), and a second group of air outlet openings in the form of radially extending slits (12) in a second sector of the plate (4). The plate (4) is rotatable adjustable in the housing (2). With this arrangement, the direction of the main air flow axis of the air flow pattern generated by the vent can be infinitely rotationally adjusted around an imaginary inverted cone, to direct the air flow where desired and avoid undesirable drafts, while still providing a highly turbulent twisting or spiraling air flow characteristic.

SUMMARY OF THE PRESENT INVENTION

The present invention relates generally to vents and, more specifically, to heating and cooling vents able to be opened and closed from a central location thereby controlling the flow of heated and cooling air to a specific area of a structure and reducing the heating and cooling costs of the structure.

A primary object of the present invention is to provide a vent control system that will overcome the shortcomings of prior art devices.

Another object of the present invention is to provide a vent control system which is able to be electronically operated from a single main control panel to open and close a vent cover.

A further object of the present invention is to provide a vent control system wherein the main control panel includes buttons located thereon for controlling respective vents of the system.

A still further object of the present invention is to provide a vent control system including a plurality of louvers opened and closed by two solenoids located on each side of the inside portion of the vent, the solenoids being controlled by activation of the buttons on the main control panel.

A yet further object of the present invention is to provide a vent control system wherein the master control panel is wired to the solenoids mounted on each side of each vent such that activation of a button on the master control panel is able to either open or close a respective vent.

An even further object of the present invention is to provide a vent control system including a plurality of louvers which move on an axis and are captive in a cover plate housing, movement of the louvers being controlled by the two solenoids wired to a main control panel for opening and closing the louvers selectively as desired.

A still further object of the present invention is to provide a vent control system that is simple and easy to use.

A yet further object of the present invention is to provide a vent control system that is economical in cost to manufacture.

Additional objects of the present invention will appear as the description proceeds.

A system for controlling the opening and closing of vents within a structure is disclosed by the present invention. The system includes a plurality of vents positioned around the structure and a control panel is centrally positioned in a readily accessible position within the structure. The vents each include a cover plate having a recess extending therethrough a plurality of louvers positioned in spaced parallel relationship within the recess and a device for automatically pivoting the plurality of louvers between an open position and closed position. The control panel includes a plurality of control buttons, each control button controlling pivoting a respective one of the plurality of louvers between the open and closed positions. A lever connects the plurality of louvers within each vent together causing the louvers to move together. The pivoting device for each vent includes first and second solenoids and a latch and spring device connected between both the first and second solenoids and the lever. The first and second solenoids are each controlled by a respective one of the control buttons to rotate causing the latch and spring device to exert a force on the lever such that the lever pivots the plurality of louvers into one of the open or closed positions. Each of the vents further includes a manually operated lever for moving the louvers between the open and closed positions.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
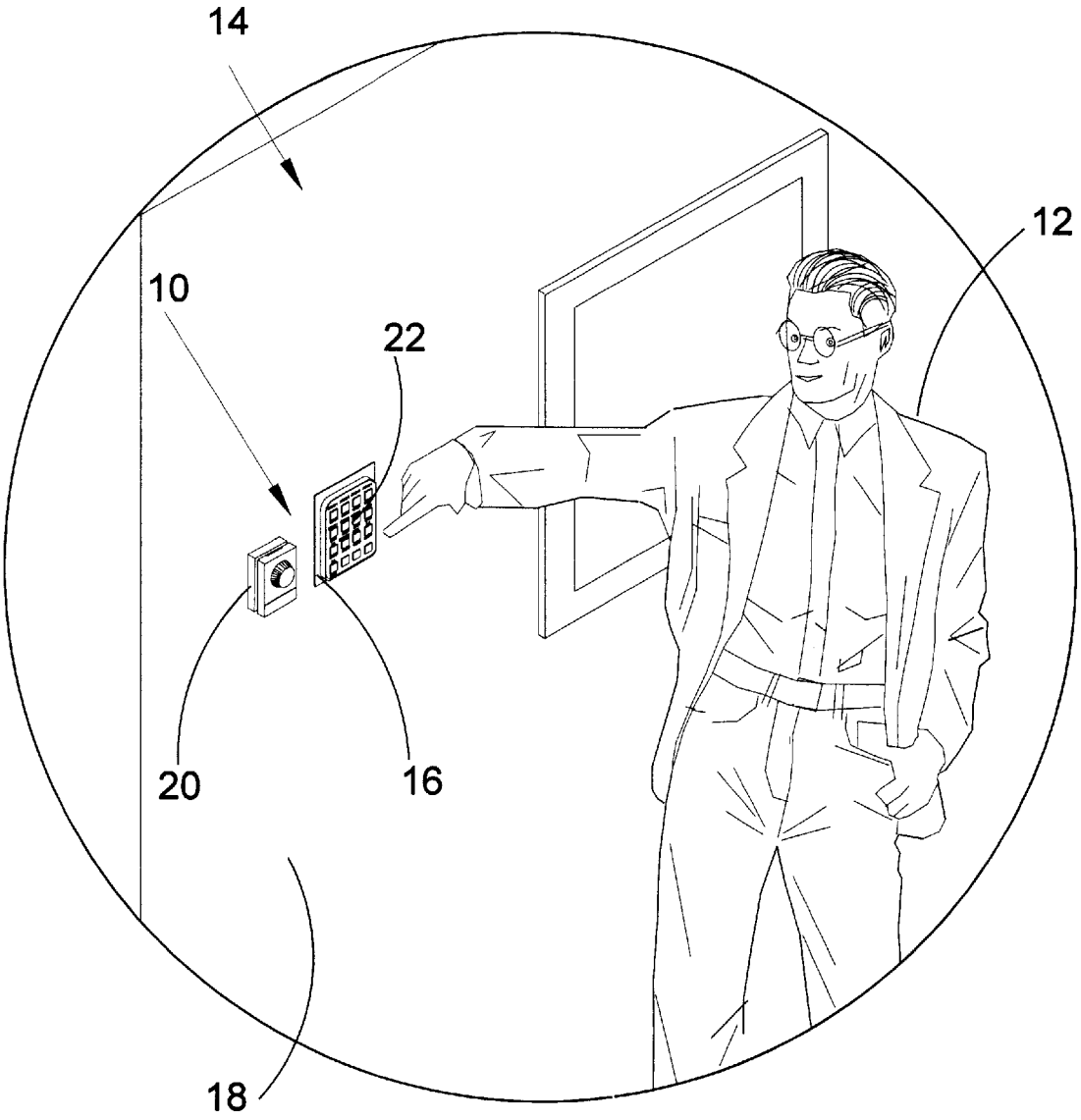
FIG. 1 is a perspective view of a home owner adjusting air flow through a vent in a desired room using the main control panel of the vent control system of the present invention.

Turning now descriptively to the drawings, in which similar reference characters denote similar elements throughout the several views, the Figures illustrate the vent control system of the present invention. With regard to the reference numerals used, the following numbering is used throughout the various drawing figures.

10 vent control system of the present invention
12 user
14 structure
16 main control panel
18 wall
20 thermostat
22 plurality of buttons on main control panel
24 vent
26 button for opening each respective vent
28 button for closing each respective vent
30 cover plate
32 recess extending through a central portion of cover plate
34 frame area
36 recess in frame area
38 plurality of louvers
40 face plate of main control panel
42 back housing of main control panel
44 connection cable connecting main control panel to individual vents
46 lever connecting louvers
48 latch and spring device
50 solenoid
52 air duct
54 control lever
56 first solenoid
58 second solenoid

DETAILED DESCRIPTION OF THE PREFERRED EMBODIMENT

Turning now descriptively to the drawings, in which similar reference characters denote similar elements throughout the several views, FIGS. 1 through 7 illustrate the vent control system of the present invention indicated generally by the numeral 10.

The vent control system 10 is shown in FIG. 1 being operated by a user 12 to control the opening and closing of vents within the structure 14. The vent control system 10 includes a main control panel 16 positioned on a wall 18 within the structure 14 and preferably adjacent to a thermostat 20. The main control panel 16 includes a plurality of buttons 22 thereon, each button controls opening or closing of a respective vent of the vent control system 10. The user 12 is shown activating a desired button to either open or close a vent. The proximity of the main control panel 16 to the thermostat 20 allows the user to also adjust the temperature of the air being supplied through the vents within the structure 14 while controlling whether each vent will be opened or closed.

Figure 2:
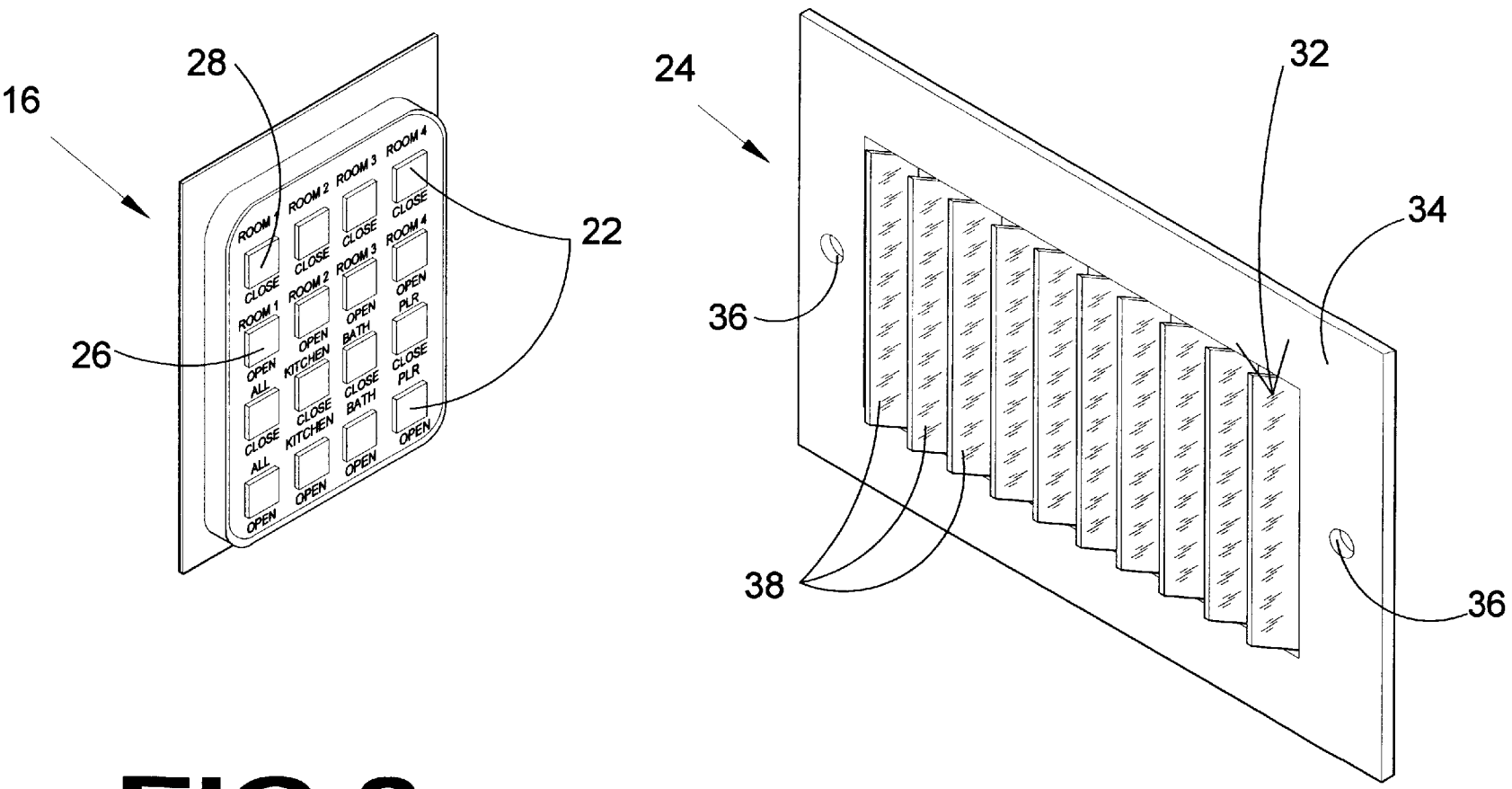
FIG. 2 is a front perspective view of the main control panel and a vent cover of the vent control system of the present invention.

An enlarged view of the main control panel 16 and a vent 24 are shown in FIG. 2. As can be seen from this view, the main control panel 16 includes the plurality of buttons 22 for controlling the individual vents 24. The main control panel 16 includes a button 26 for opening each respective vent 24 and a button 28 for closing each respective vent 24. Each vent 24 includes a cover plate 30. The cover plate 30 includes a recess 32 extending through a central portion thereof and a frame area 34 surrounding the recess 32. Positioned on the frame area 34 is at least one recess 36 for use in securing the vent 24 to a wall surface. The use of a recess 36 for securing the vent 24 to a wall 18 with a screw or tack is for purposes of example only. Any know device for securing the vent 24 to a wall may be used and falls within the scope of the present invention. Extending either vertically or horizontally within the recess 32 are a plurality of louvers 38. The louvers 38 are positioned to extend in a spaced parallel relationship with each other. In an open position, the louvers 38 allow heated or cooled air to pass through the vent 24. In the closed position, the louvers 38 prevent the passage of heated or cooled air to pass through the vent thereby effectively shutting the vent 24 and eliminating the costs associated with heating or cooling the room to which the vent 24 leads. When the button 26 indicating a respective vent 24 should be opened is activated, the louvers 38 of that vent are caused to pivot into a position allowing air to pass from an air duct and through the recess 32 into the room in which the vent 24 is positioned. When the button 28 indicating a respective vent 24 should be closed is activated, the louvers 38 of that vent are caused to pivot into a position preventing air from passing through the recess 32 and into the room in which the vent 24 is positioned.

Figure 3:
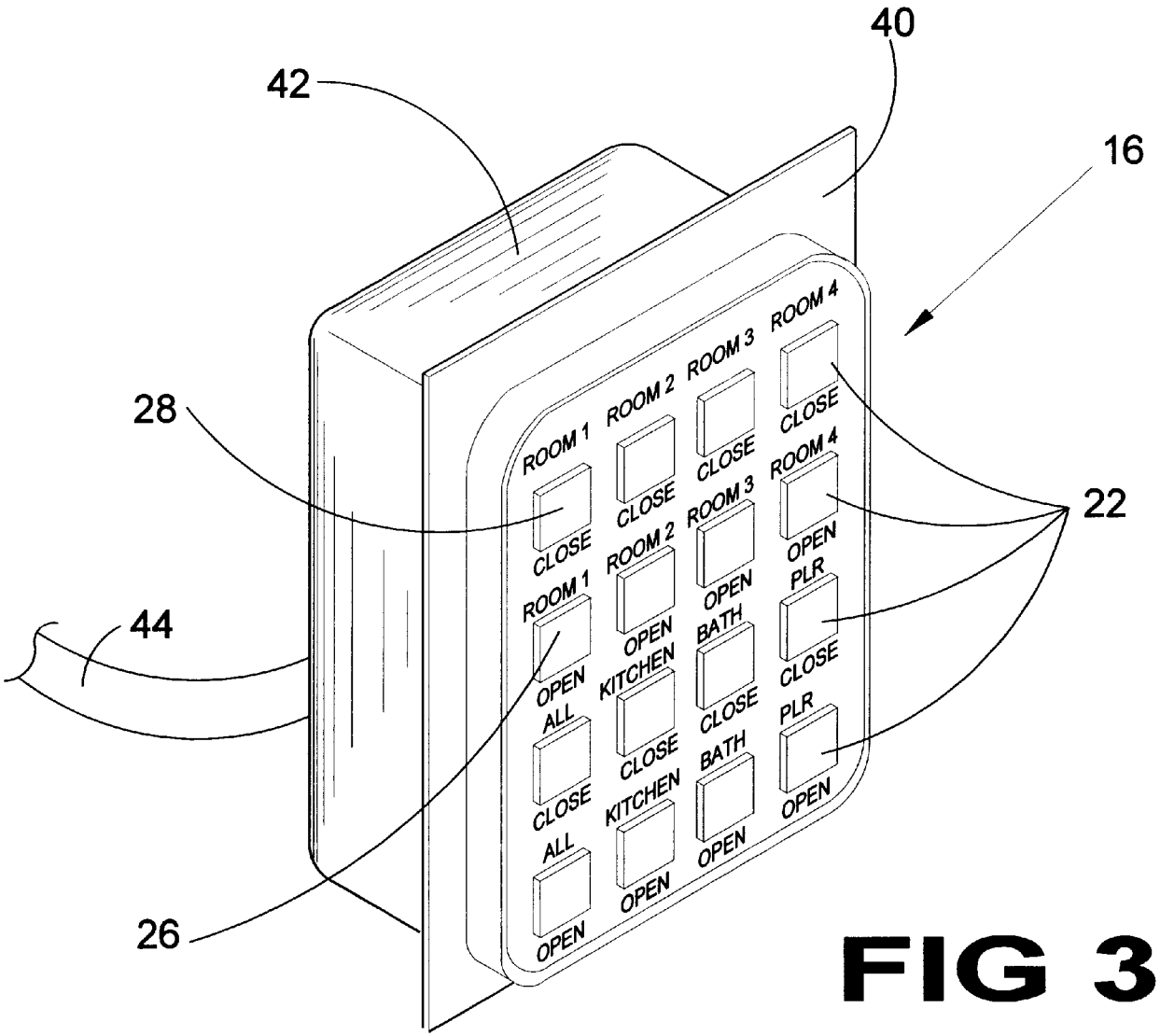
FIG. 3 is a perspective view of the main control panel of the vent control system of the present invention.

An enlarged view of the main control panel 16 is illustrated in FIG. 3. The main control panel 16 includes a face plate 40 and a back housing 42. Positioned on the face plate 40 are the plurality of control buttons 22. The plurality of control buttons 22 include a pair of buttons for controlling the position of the vent 24 in each room of the structure 14. The pair of buttons for each room includes an open vent button 26 and a close vent button 28. Within the back housing 42 of the main control panel 42 is the circuitry for generating a control signal for opening and closing each respective vent 24. A connection cable 44 extends from the back housing 42 to each individual vent 24. The control signal generated by activation of a particular one of the plurality of buttons 22 is transmitted through the control cable 44 to the respective vent 24 being controlled thereby.

Figure 4:
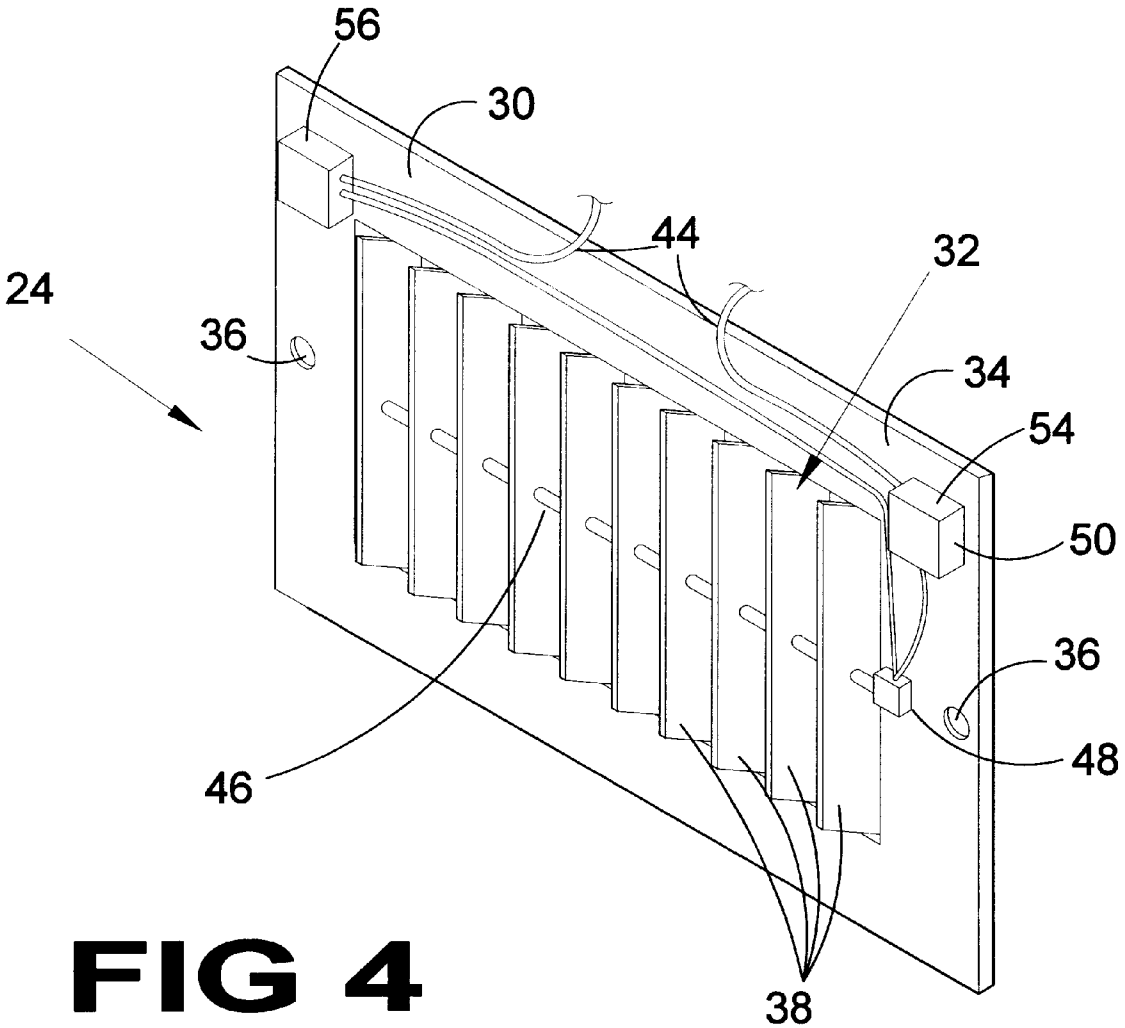
FIG. 4 is a perspective view of a vent cover of the vent control system of the present invention.

An enlarged view of a back side of a vent 24 is illustrated in FIG. 4. From this view, the components controlling the opening and closing of the vent 24 are shown. Connecting the louvers 38 of the vent 24 and thereby causing the louvers 38 to move together is a lever 46. The lever 46 extends through each of the plurality of louvers 38 causing the louvers 38 to move together and retain their parallel spaced relationship. At an end of the lever 46 and connected to the back side of the frame 34 is a latch and spring device 48. The latch and spring device 48 is connected to a pair of solenoids 50. The pair of solenoids 50 are connected to the main control panel 16 via the connection cable 44. A first solenoid 56 of the pair of solenoids 50 is caused to rotate in a first direction upon activation of the button 26 for opening the vent 24. Rotation of the first solenoid 56 causes the latch and spring device 48 to exert a force on the lever 46 to move in a first direction and thereby rotate the louvers 38 into an open position allowing air to pass through the vent 24. A second solenoid 58 of the pair of solenoids 50 is caused to rotate in a second direction opposite the first direction upon activation of the button 28 for closing the vent 24. Rotation of the second solenoid 58 causes the latch and spring device 48 to exert a force on the lever 46 to move in a second direction opposite the first direction and thereby rotate the louvers 38 into a closed position preventing air from passing through the vent 24. The first and second solenoids 56 and 58, respectively, are preferably located on each side of the inner side of the vent cover frame 24. However, the solenoids may be situated in any position on the frame 34 so as not to interfere with installation of the vent cover 24.

Figure 5:
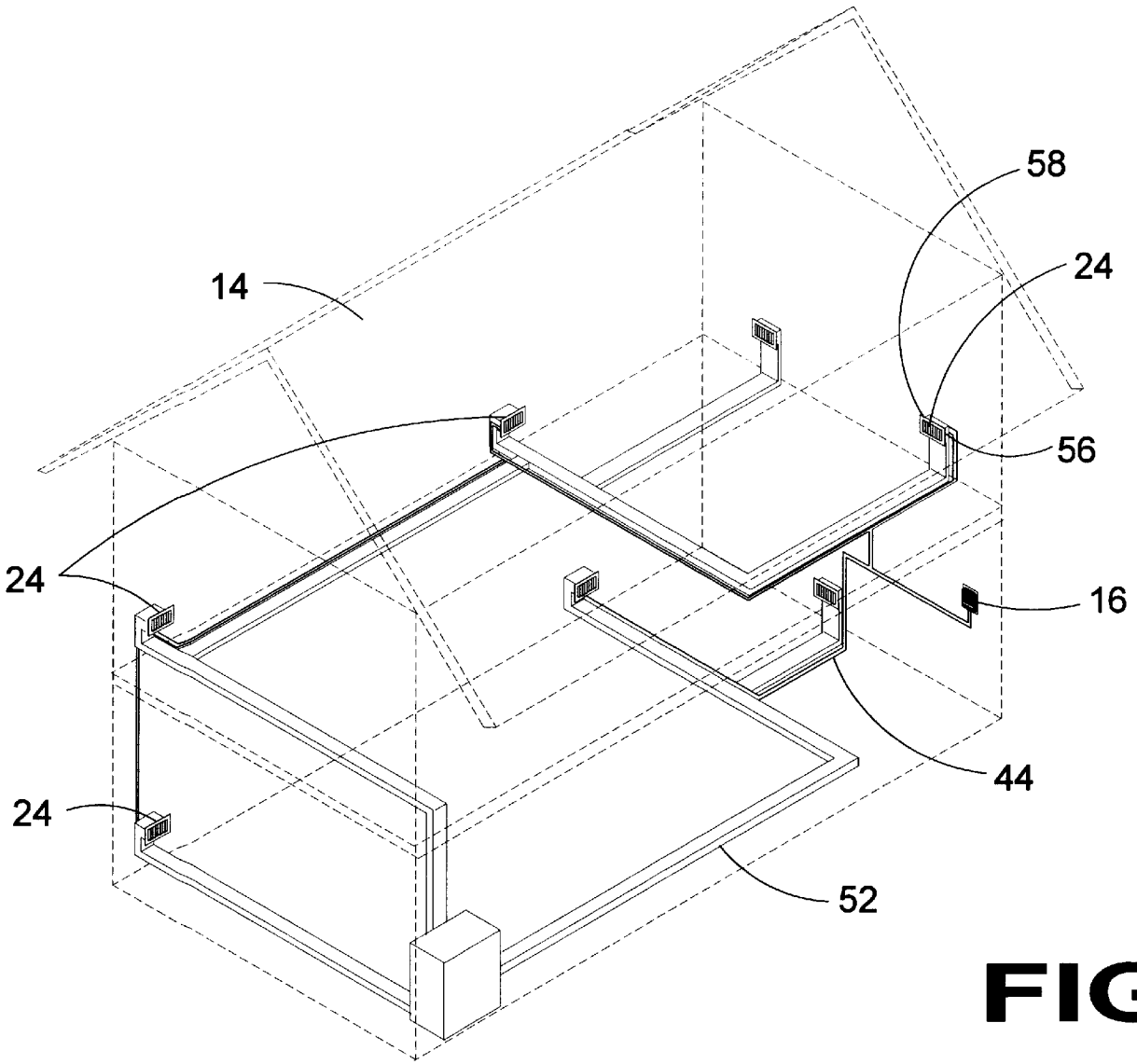
FIG. 5 is a perspective view of a plurality of vent control units positioned within respective rooms of a structure and the main control panel for controlling the vent control units of the vent control system of the present invention, the structure being shown in dashed lines.

A perspective view of the vent control system 10 of the present invention installed within a structure 14 is illustrated in FIG. 5. This figure illustrates the connection of the vents 24 via an air duct 52 extending throughout the structure 14. The control panel 16 is positioned in a central easily accessible location within the structure 14. The control panel 16 is connected to the first and second solenoids 56 and 58, respectively, of each duct 24 via the connection cable 44. The button 26 causing the louvers to open and the button 28 causing the louvers 38 to close for each respective vent 24 are connected to the first and second solenoids 56 and 58, respectively, for the respective vent 24 through the connection cables 44.

Figure 6:
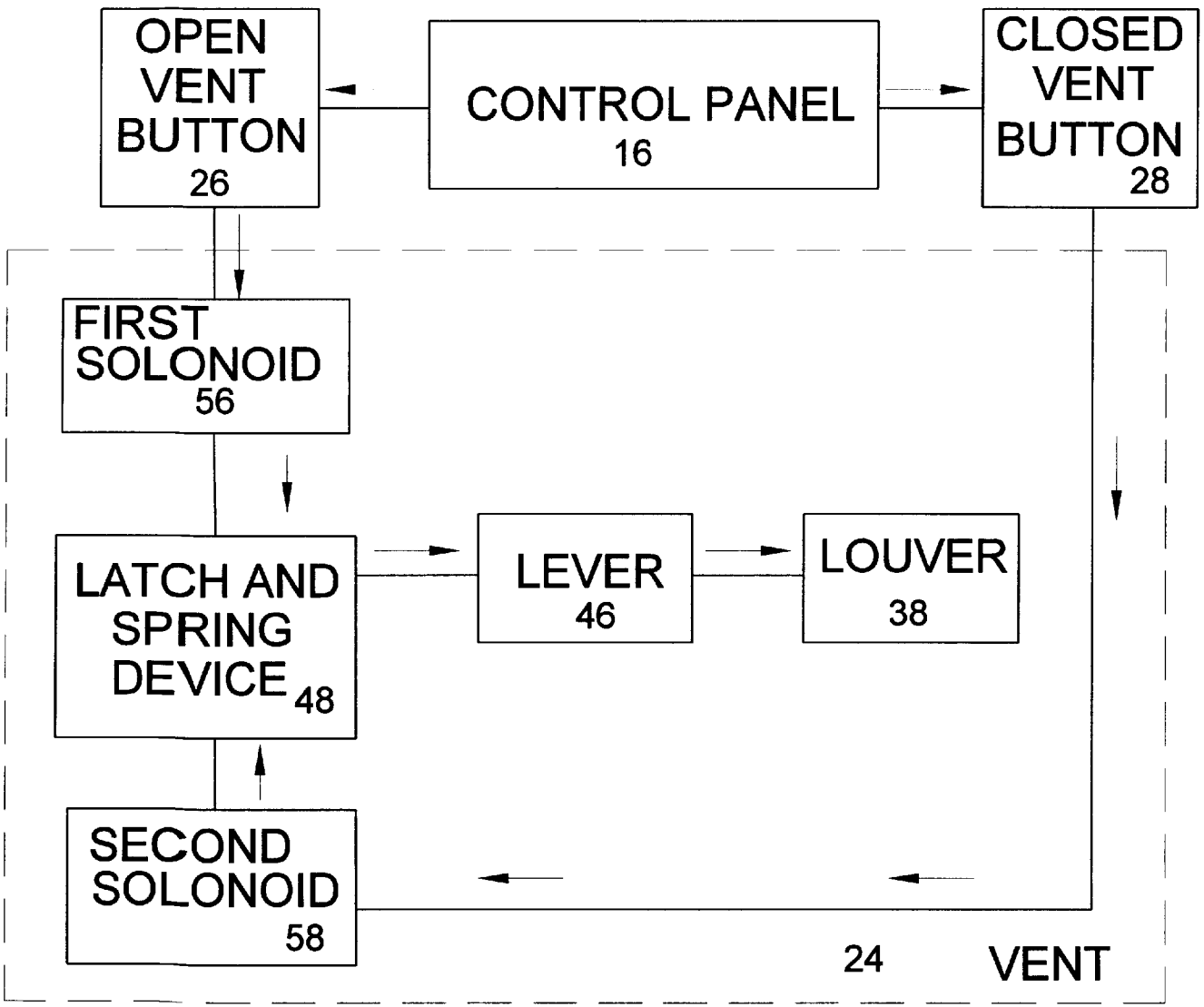
FIG. 6 is a block diagram of a connection between the main control panel and a single vent of the vent control system of the present invention.

A block diagram illustrating the opening and closing of the louvers 38 is shown in FIG. 6. As can be seen from this view, the control panel includes the open vent button 26 and the closed vent button 28. The open vent button 26 is connected to the first solenoid 56. When activated the open vent button 26 generates a signal which is transmitted to the first solenoid 56 causing the first solenoid to rotate. The rotation of the first solenoid 56, activates the latch and spring device 48. The latch and spring device applies a force on the lever 46 to move in a first direction. The movement of the lever in the first direction causes the louvers 38 connected thereto to rotate about an axis and thereby open a passageway through the recess 32 in the vent cover 24. The close vent button 28 is connected to the second solenoid 58. When activated the close vent button 28 generates a signal which is transmitted to the second solenoid 58 causing the second solenoid 58 to rotate in a direction opposite the direction of rotation of the first solenoid 56. The rotation of the second solenoid 58, activates the latch and spring device 48. The latch and spring device applies a force on the lever 46 to move in a second direction opposite the first direction. The movement of the lever 46 in the second direction causes the louvers 38 connected thereto to rotate about the axis in a direction opposite that caused by activation of the open vent button 26 and thereby close the passageway through the recess 32 in the vent cover 24.

Figure 7:
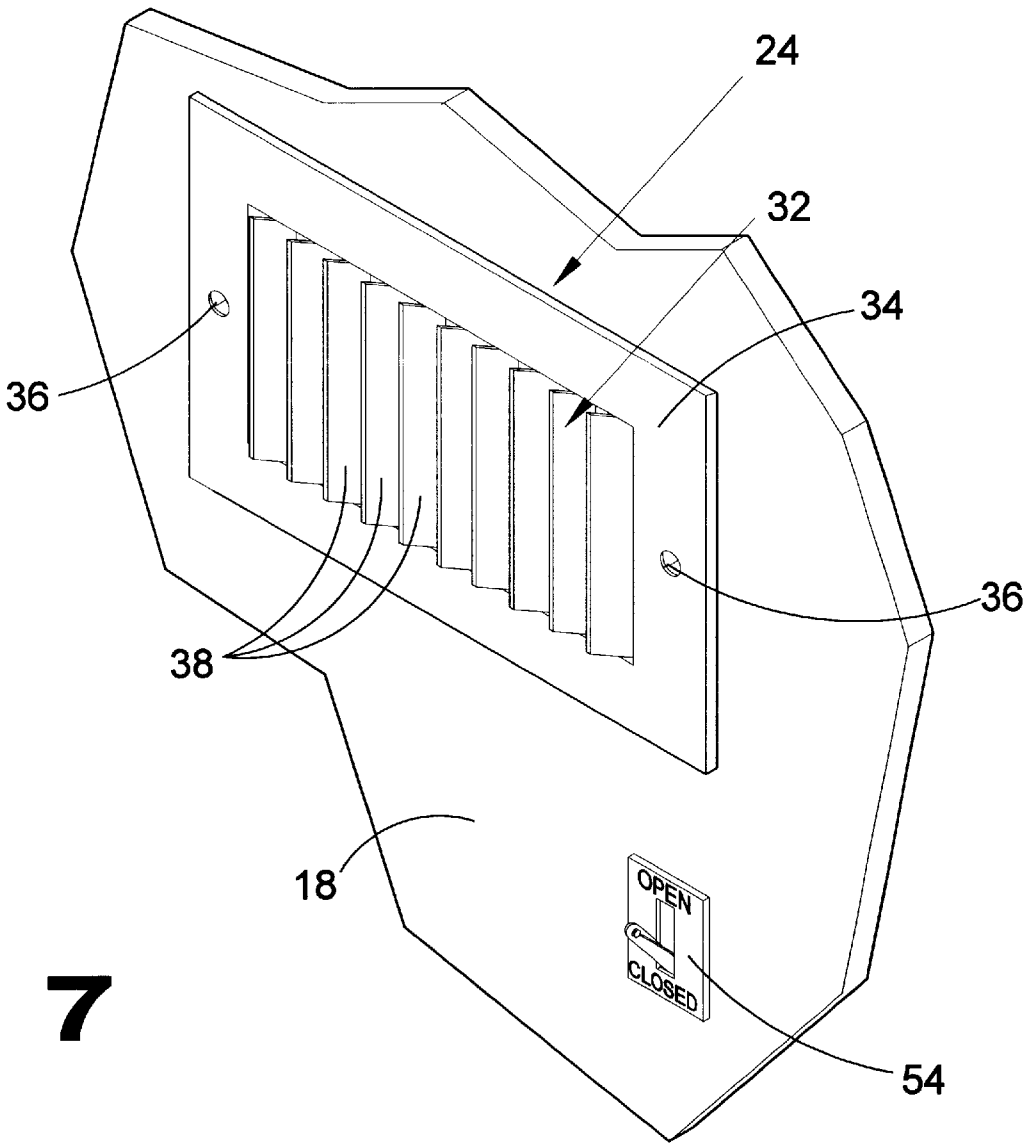
FIG. 7 is a perspective view of a vent cover including a manual control switch for opening and closing the vents in the vent control system of the present invention.

A perspective view of the vent 24 used with the vent control system 10 of the present invention including a manual control lever is illustrated in FIG. 7. As can be seen from this view, the vent includes the cover plate 30. The cover plate 30 includes the recess 32 extending through a central portion thereof and the frame area 34 surrounding the recess 32. Positioned on the frame area 34 is the at least one recess 36 for securing the vent 24 to a wall surface. Extending either vertically or horizontally within the recess 32 are the plurality of louvers 38. The louvers 38 are positioned to extend in spaced parallel relationship with each other. In an open position, the louvers 38 allow heated or cooled air to pass through the vent 24. In the closed position, the louvers 38 prevent the passage of heated or cooled air to pass through the vent thereby effectively shutting the vent 24 and eliminating the costs associated with heating or cooling the room to which the vent 24 leads. When the control lever 54 is moved into a first position indicating a respective vent 24 should be opened, the movement of the control lever 54 acts on the latch and spring device 48. The latch and spring device 48 in turn applies a force to the lever 46 causing the louvers 38 to pivot into a position allowing air to pass from an air duct and through the recess 32 into the room in which the vent 24 is positioned. When the control lever 54 is activated by being moved into a second position indicating a respective vent 24 should be closed, the movement of the control lever 54 acts on the latch and spring device 48. The latch and spring device 48 in turn applies a force to the lever 46 causing the louvers 38 to pivot into a position preventing air from passing through the recess 32 and into the room in which the vent 24 is positioned.

The operation of the vent control system 10 will now be described with reference to the figures. In operation, the vent control system 10 is installed into a structure 14. In doing such, the main control panel 16 is positioned in a central easily accessible location. The vent covers 30 are positioned at the entrance of each air duct 52 into a room of the structure 14. The open vent buttons 26 and closed vent buttons 28 of the main control panel 16 are then connected to their respective solenoids 56 or 58. The vent control system of the present invention is now installed within the structure 14 and ready for use.

When it is desired to open a specific vent 24 within a room, the open vent button 26 for that specific vent 24 is activated. Upon activation, the open vent button 26 generates a control signal which is transmitted to the first solenoid 56 via the connection cable 44. The control signal causes the first solenoid 56 to rotate. The rotation of the first solenoid 56 activates the latch and spring device 48. The latch and spring device 48 applies a force on the lever 46 to move in a first direction. The movement of the lever in the first direction causes the louvers 38 connected thereto to rotate about an axis and thereby open a passageway through the recess 32 in the vent cover 24.

When it is desired to close a specific vent 24 within a room, the close vent button 28 for that specific vent 24 is activated. Upon activation, the close vent button 28 generates a control signal which is transmitted to the second solenoid 58 via the connection cable 44. When activated the close vent button 28 generates a signal which is transmitted to the second solenoid 58 causing the second solenoid 58 to rotate in a direction opposite the direction of rotation of the first solenoid 56. The rotation of the second solenoid 58, activates the latch and spring device 48. The latch and spring device 48 applies a force on the lever 46 to move in a second direction opposite the first direction. The movement of the lever 46 in the second direction causes the louvers 38 connected thereto to rotate about the axis in a direction opposite that caused by activation of the open vent button 26 and thereby close the passageway through the recess 32 in the vent cover 24.

This action is repeated upon activation of any of the control buttons 22 of the control panel 16. When it is desired to open a specific vent, the control button for that respective vent is activated and the above action opening the vent 24 takes place. When it is desired to close a specific vent, the control button for that respective vent is activated and the above action closing the vent 24 takes place. Alternatively, the user may manually open and close the desired vents using the control lever 54. Movement of the control lever 54 in a first direction will cause the louvers 38 to move into a position whereby the vent is open and movement of the control lever 54 in a second direction will cause the louvers 38 to move into a position whereby the vent is closed.

From the above description it can be seen that the vent control system of the present invention is able to overcome the shortcomings of prior art devices by providing a vent control system which is able to electronically operated from a single main control panel to open and close a vent cover, the main control panel including buttons located thereon for controlling respective vents of the system. The vent control system also includes a plurality of louvers opened and closed by two solenoids located on each side of the inside portion of the vent, the solenoids being controlled by activation of the buttons on the main control panel. The louvers move on an axis and are captive in a cover plate housing, movement of the louvers being controlled by the two solenoids wired to a main control panel for opening and closing the louvers selectively as desired. Furthermore, the vent control system of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A system for controlling the opening and closing of vents within a structure, said system comprising:

a) a plurality of vents positioned around the structure, said vents each including:

i) a cover plate having a recess extending therethrough;

ii) a plurality of louvers positioned in spaced parallel relationship within said recess, with a lever connecting said plurality of levers causing each of said louvers to move together; and iii) means for pivoting said plurality of louvers between an open position and closed position comprising a latch and spring device;

b) a control panel including a plurality of control buttons, each control button directly controlling pivoting the louvers in a specific vent between said open and closed positions;

c) a pair of solenoids in each of said vents, one of said solenoids being activated to move said louvers into an open position and the second of said solenoids being activated to move the louvers in the vent into a closed position; and d) each solenoid in each vent having an associated and identified button in said control panel for directly activating the associated solenoid so that in said control panel there is a first button and a second button for each vent wherein activation of said first button causes said latch and spring device to pivot said louvers into the open position and activation of said second button causes said latch and spring device to pivot the louvers into the closed position.

2. The vent control system as recited in claim 1, further comprising means for securing each of said vents to a wall of said structure covering a respective air duct.

3. The vent control system as recited in claim 1, wherein each of said plurality of vents further includes a manually operated lever for moving said plurality of louvers between said open and closed positions.

4. The vent control system as recited in claim 1, wherein said control panel is centrally positioned in a readily accessible position within the structure.

* * * * *